US007819127B1

(12) United States Patent
Huffman

(10) Patent No.: US 7,819,127 B1
(45) Date of Patent: Oct. 26, 2010

(54) SURFACE CLEANING APPARATUS WITH IONIZED LIQUID SUPPLY

(75) Inventor: Eric C. Huffman, Lowell, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 0 days.

(21) Appl. No.: 12/632,684

(22) Filed: Dec. 7, 2009

Related U.S. Application Data

(63) Continuation of application No. 11/945,663, filed on Nov. 27, 2007, now abandoned.

(60) Provisional application No. 60/867,318, filed on Nov. 27, 2006.

(51) Int. Cl.
*B08B 3/10* (2006.01)

(52) U.S. Cl. ..... 134/198; 134/21; 422/28; 15/320

(58) Field of Classification Search ..... 422/28; 134/21, 198; 15/320
See application file for complete search history.

(56) References Cited

U.S. PATENT DOCUMENTS

| | | | | |
|---|---|---|---|---|
| 6,609,269 | B2 | 8/2003 | Kasper | |
| 2003/0159233 | A1 | 8/2003 | Oh | |
| 2005/0029124 | A1 * | 2/2005 | Holmes et al. | 205/687 |
| 2007/0187263 | A1 * | 8/2007 | Field et al. | 205/742 |

OTHER PUBLICATIONS

Richard White, PhD; Keith Cutting, MN, RN, Dip n Cert ED, "Exploring the Effects of Silver in Wound Management—What is Optimal?", Emdeon Business Services, http:/www.medscape.com/viewarticle/549223, Posted Jan. 1, 2007, pp. 1-4.

T.J. Berger, et al., Electrically Generated Silver Ions: Quantitative Effects on Bacterial and Mammalian Cells, Antimicrobial Agents and Chemotherapy, Feb. 1976, p. 357-358, vol. 9, No. 2, Printed in U.S.A.

Kusnetsov, et al., Copper and Silver Ions More Effective Against Legionellae than Against Mycobacteria in a Hospital Warm Water System, Water Research ISSN 0043-1354, Dec. 7, 2009, vol. 35, n 17, pp. 4217-4225 (1 p. 1/4).

K.C. Chaw, et al., Role of Silver Ions in Destabilization of Intermolecular Adhesion Forces Measured by Atomic Force Microscopy in *Staphylococcus epidermidis* Biofilms, Antimicrobial Agents and Chemotherapy,Dec. 2005, p. 4853-4859 vol. 49, No. 12 Copyright 2005, American Society for Microbiology.

(Continued)

*Primary Examiner*—Sean E Conley
(74) *Attorney, Agent, or Firm*—McGarry Bair PC

(57) ABSTRACT

Surface cleaning includes applying a metal ion solution onto a surface to be cleaned, wherein the metal ion concentration in the cleaning solution as applied to the surface is effective to at least inhibit growth of microbes on the surface to be cleaned. An apparatus includes a metal ion generator that generates metal ions that are applied to a surface for disinfecting the surface. The metal ion generator is coupled to a liquid distribution system and power supply for generating metal ions and introducing the metal ions into a cleaning liquid. The metal ions can be distributed over the surface during application of the cleaning liquid to the surface.

10 Claims, 6 Drawing Sheets

OTHER PUBLICATIONS

Tsai WC, et al., In Vitro Quantitative Study of Newly Made Antibacterial Braided Nylon Suture, Pub Med, Sep. 1987; 165(3):207-11. Dec. 7, 2009 U.S. National Library of Medicine National Institute of Health.

Franck Furno, et al., Silver Nanoparticles and Polymeric Medical Devices: A New Approach to Prevention of Infection?, Journal of Antimicrobial Chemotherapy, (Nov. 10, 2004) 54, 1019-1024, United Kingdom.

Jorg Michael Schierholz, et al., Letters to the Editor—Silver-Containing Polymers, Antimicrobial Agents and Chemotherapy, Nov. 1999, p. 2819-2821, vol. 43, No. 11, American Society for Microbiology.

T.J. Berger, et al., Antifungal Properties of Electrically Generated Metallic Ions, Antimicrobial Agents and Chemotherapy, Nov. 1976, p. 856-860, vol. 10, No. 5, U.S.A.

Patricia C. Mackeen, et al., Silver-Coated Nylon Fiber as an Antibacterial Agent, Antimicrobial Agents and Chemotherapy, Jan. 1987, p. 93-99, vol. 31, No. 1, American Society for Microbiology, Pennsylvania.

Cory O'Neill, et al., Durability of Hydrophilic and Antimicrobial Zeolite Coatings Under Water Immersion, Materials, Interfaces, and Electrochemical Phenomena, Mar. 2006, vol. 52, No. 3, American Institute of Chemical Engineers Journal.

Samsung Silver Nano Health System Gives Free Play to its Silver Magic, Mar. 29, 2005, Samsung's Digital World—Press Release.

Mark Hanlon, Samsung Set to Launch Silver Nano Wash System that Kills 99% of Bacteria, Jul. 30, 2005, www.gizmag.com/go/4516/.

Wikipedia, Dec. 7, 2009, Silver Nano—Wikipedia, the free encyclopedia, http://en.wikipedia.org/wiki/Silver_Nano.

* cited by examiner

SURFACE CLEANING APPARATUS WITH IONIZED LIQUID SUPPLY

CROSS-REFERENCE TO RELATED APPLICATIONS

This application claims the benefit of U.S. provisional application Ser. No. 60/867,318, filed Nov. 27, 2006, which is incorporated herein in its entirety, and is a continuation of U.S. Ser. No. 11/945,663, filed Nov. 27, 2006.

BACKGROUND OF THE INVENTION

1. Field of the Invention

This invention relates to a surface cleaning apparatus that delivers cleaning liquid to a surface to be cleaned. In one of its aspects, the invention relates to a surface cleaning apparatus that delivers an ionized liquid solution to a surface to be cleaned for enhanced cleaning. In another of its aspects, the invention relates to a method of cleaning a surface.

2. Description of the Related Art

Extractors are well-known devices for deep cleaning carpets and other fabric surfaces, such as upholstery. Most carpet extractors comprise a liquid distribution assembly and a liquid recovery assembly. The liquid distribution assembly typically includes one or more liquid supply tanks for storing a supply of cleaning liquid, a liquid distributor for applying the cleaning liquid to the surface to be cleaned, and a liquid supply conduit for delivering the cleaning liquid from the liquid supply tank to the liquid distributor. An example of an extractor is disclosed in commonly assigned U.S. Pat. No. 6,609,269 to Kasper, which is incorporated herein by reference in its entirety.

Extractors clean carpets and upholstery typically by applying a cleaning solution to the surface, followed by rinsing and drying. While such a process, and the cleaning liquids used therefor, can remove soil and stains, it typically does not sanitize the surface. Microorganisms, molds, and other pathogens can remain after cleaning.

U.S. Application Publication No. 2003/0159233 of Oh discloses a canister-type vacuum cleaner incorporating an apparatus for generating an electrolytic liquid and spraying the electrolytic liquid onto the surface to be cleaned. The electrolytic liquid generator comprises a pair of electrolyte baths containing water and a catalyzer, such as sodium chloride or calcium chloride, each bath incorporating a cathode and an anode. The generated electrolytic liquid comprises sodium hypochlorite (NaClO), also referred to as household chlorine bleach. The electrolytic liquid has the stain removal and anti-microbial properties of chlorine bleach.

Harsh chemicals effective in removing microorganisms can damage the surface. The use of heat to sanitize the surface, while effective, is also problematic. Generating sufficient heat, particularly steam, is difficult in a typical extractor due to competing concerns over the complex apparatus necessary for steam generation while remaining within desired size limitations, safety concerns, and required power consumption. Additionally, maintaining the surface at an elevated temperature for a sufficient period of time for sanitizing would retard the cleaning process since it would be necessary to retain the extractor at a selected location for a period of time sufficient for a sanitation to be completed before moving on to an adjacent area.

SUMMARY OF THE INVENTION

In an exemplary embodiment of the invention, an apparatus for cleaning a surface is provided having a liquid dispenser for applying a liquid to a surface, and a liquid recovery assembly having a suction nozzle, a liquid recovery tank, and a suction source for drawing liquid from a surface into said recovery tank. In various embodiments of the invention, the apparatus comprises a power supply; a liquid distribution assembly including: a cleaning liquid supply reservoir for holding a supply of cleaning liquid, a surface cleaner liquid supply reservoir for holding a surface cleaner including at least one of a detergent and a surfactant for combining with a supply of cleaning liquid from said cleaning liquid supply reservoir to form a cleaning solution; and a metal ion generator having a pair of metallic electrodes in spaced disposition, said metal ion generator being adapted to introduce metal ions into the cleaning liquid when coupled to the power supply and power is supplied to the electrodes.

Various other example embodiments of the invention are also contemplated. The metal ion generator can comprise an anode and a cathode connected to an electric power supply. The apparatus can further comprise a potentiometer for adjusting the voltage differential across the anode and the cathode. The apparatus can further comprise a switch for selectively reversing the polarity of the electrical potential across the anode and the cathode.

The metal ions can be selected from the group consisting of silver, zinc, and copper. The metal ion generator can introduce ions into the cleaning liquid stored in the cleaning liquid supply reservoir. The metal ion generator can introduce ions into the cleaning liquid downstream from the cleaning liquid supply reservoir, but before the cleaning liquid has been dispensed from the apparatus onto the surface being cleaned.

DESCRIPTION OF THE PREFERRED EMBODIMENT

Figure 1:
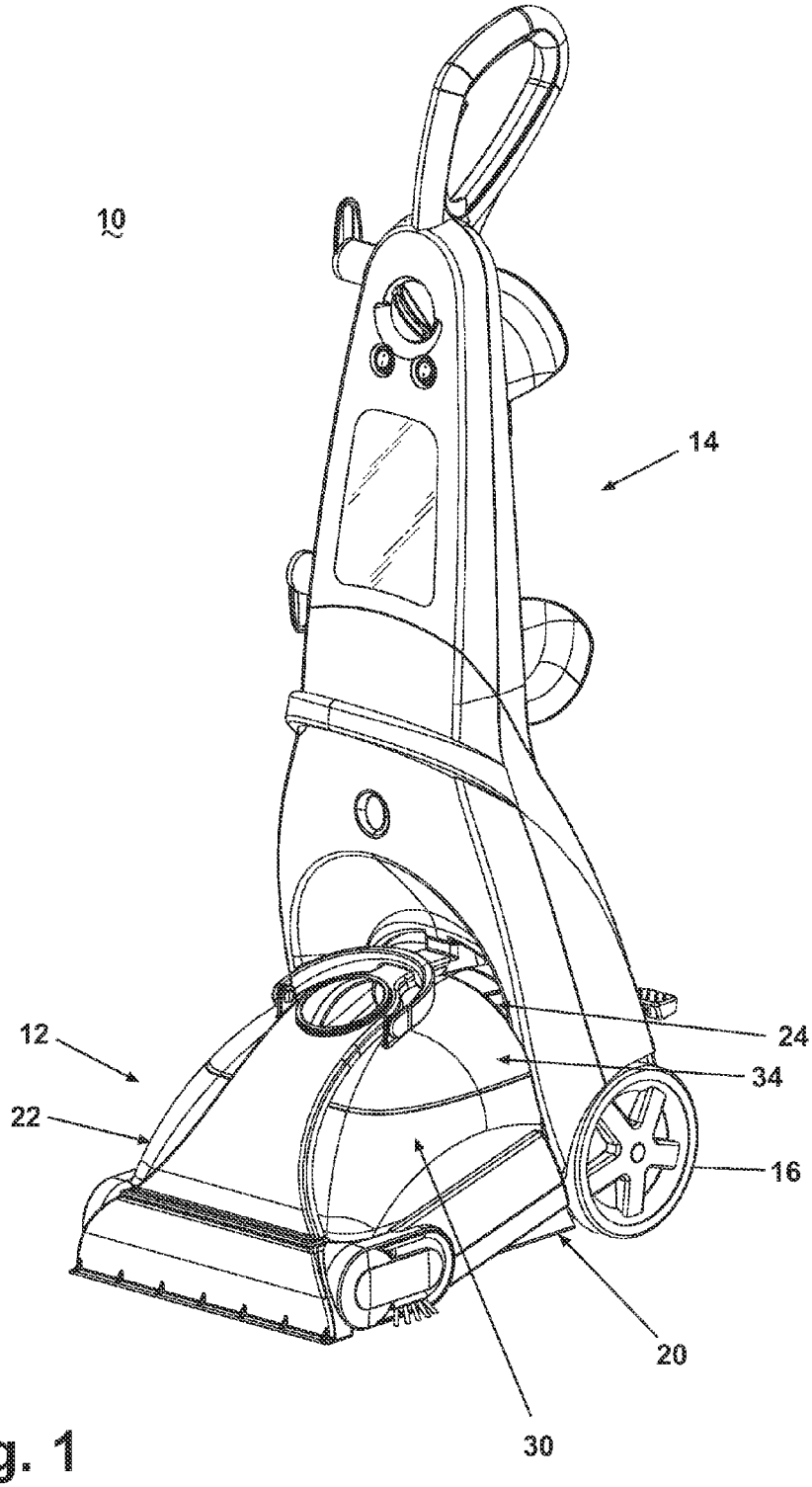
FIG. 1 is a front, right perspective view of an extractor having an ion generator according to an embodiment of the invention, with a handle assembly pivotally mounted to a foot assembly.
Figure 2:
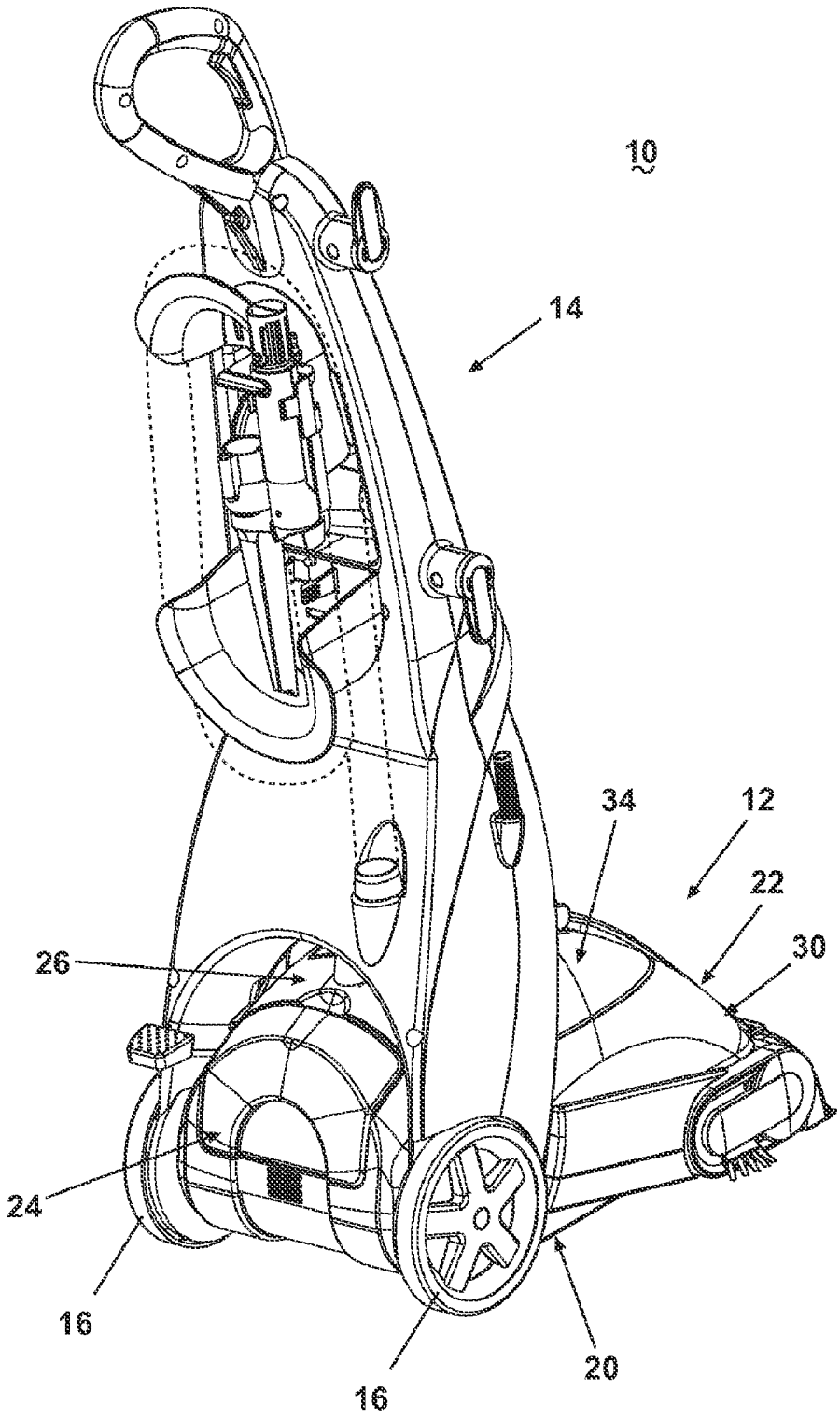
FIG. 2 is a rear, left perspective view of the extractor of FIG. 1.
Figure 3:
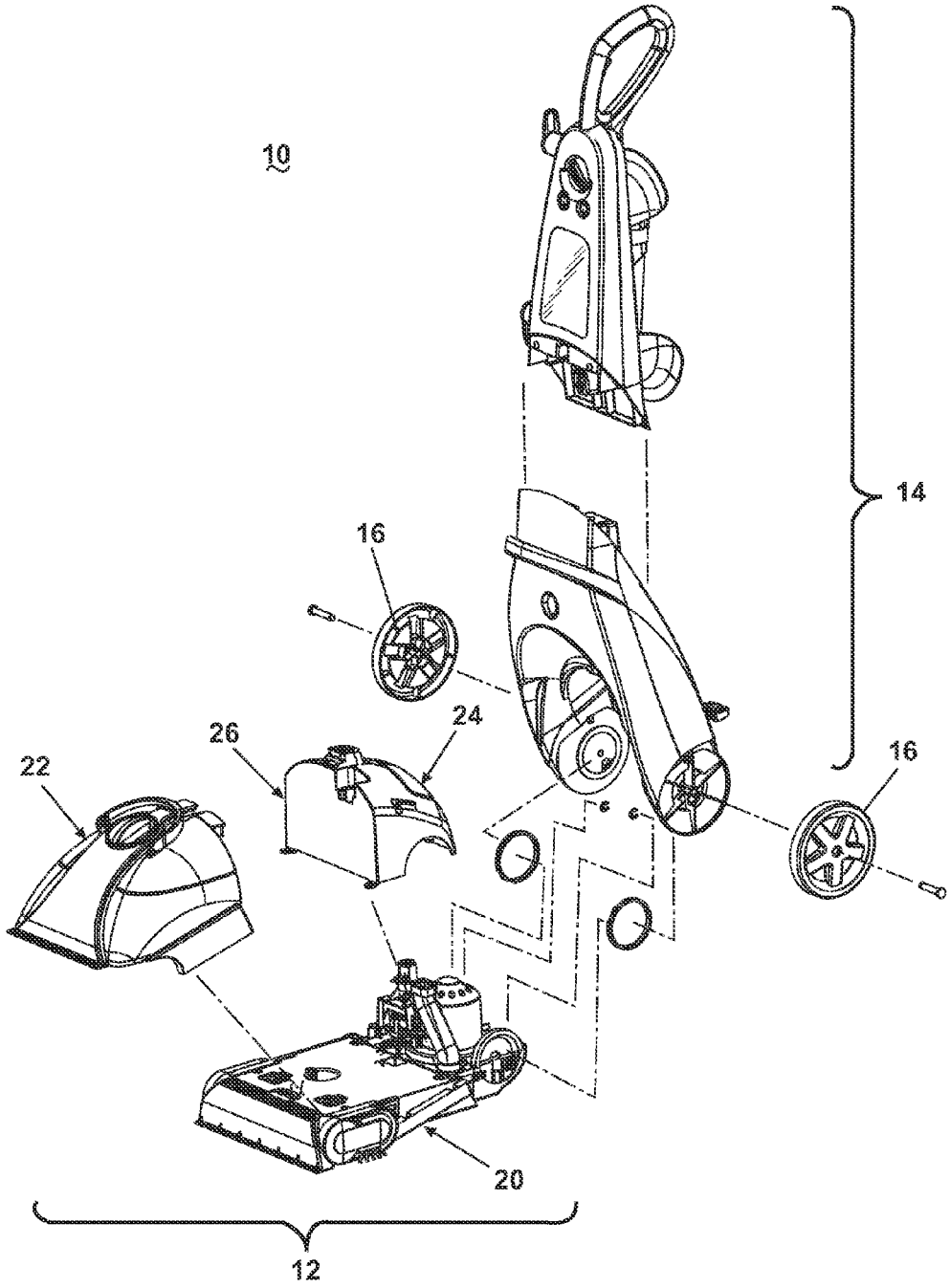
FIG. 3 is an exploded view of the foot assembly and the handle assembly of the extractor of FIG. 1, wherein the foot assembly is exploded to show a recovery tank assembly, a solution supply tank assembly, a base assembly, and a foot assembly cover, and the handle assembly is exploded into an upper handle and a lower handle.

Referring now to the drawings and particularly to FIGS. 1-3, an upright extractor 10 according to the invention comprises a housing having a foot assembly 12 supported on wheels 16 for movement across a surface to be cleaned, and a handle assembly 14 pivotally mounted to a rearward portion of the foot assembly 12 for directing the foot assembly 12 across the surface to be cleaned. The extractor 10 shares many of the features of an extractor described and illustrated in U.S. Pat. No. 6,609,269 to Kasper, which is incorporated herein by reference in its entirety. Such features may include one or more motors, agitator assemblies, control switches, valves, liquid distribution assemblies, liquid reservoirs, vacuum assemblies, and cleaning accessories, and will not be described in detail herein except as necessary for a complete understanding of the invention.

The extractor 10 can include a generally well-known liquid distribution assembly 34 for storing cleaning liquid and delivering the cleaning liquid to the surface to be cleaned, and a liquid recovery assembly for removing the spent cleaning liquid and dirt from the surface to be cleaned and storing the spent cleaning liquid and dirt. The components of the liquid distribution assembly and the liquid recovery assembly are supported by at least one of the foot assembly 12 and the handle assembly 14.

Figure 4:
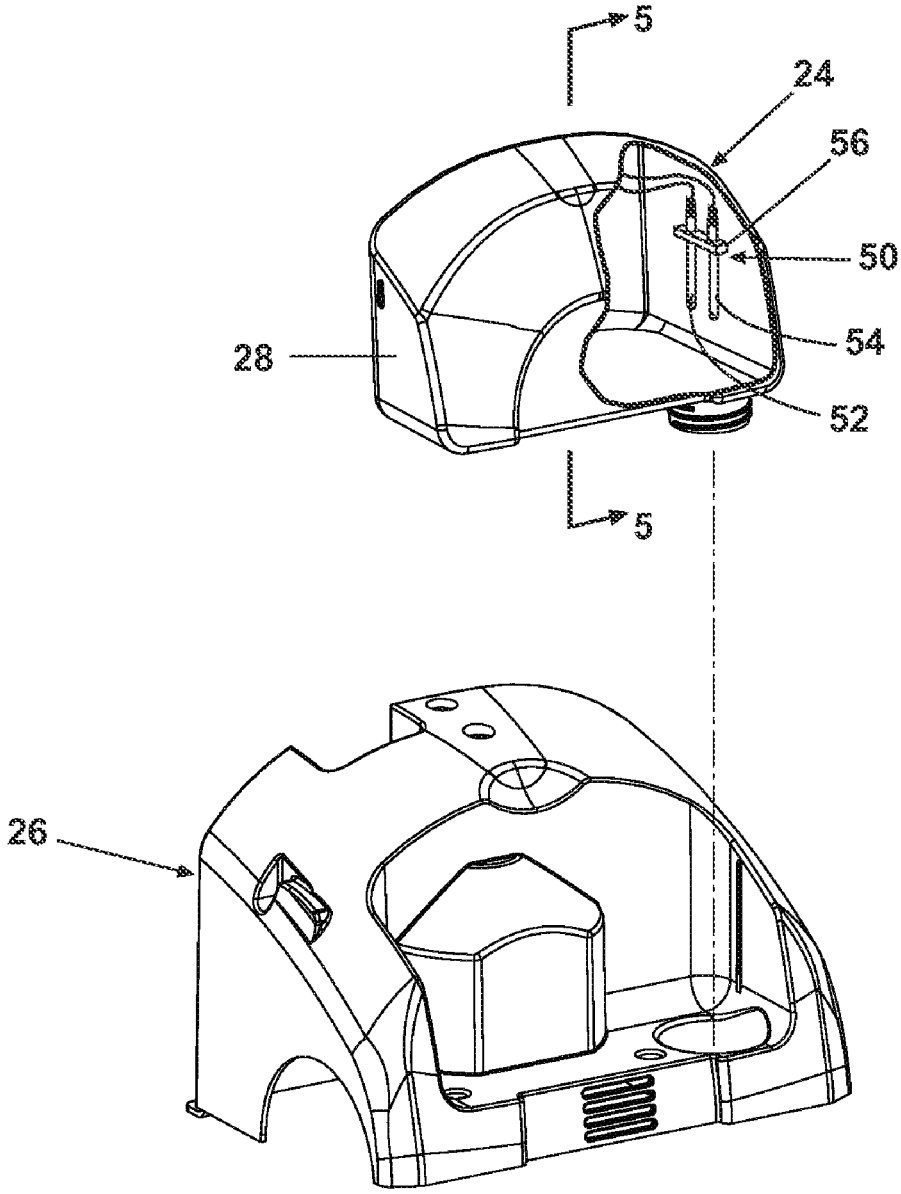
FIG. 4 is a rear exploded view of the solution supply tank assembly and the foot assembly cover of FIG. 3 showing the ion generator mounted in the solution supply tank assembly.

The foot assembly 12 comprises a base assembly 20 that supports a recovery tank assembly 22 at a forward portion thereof, and a solution supply tank assembly 24 at a rearward portion thereof. The recovery tank assembly 22 can comprise a tank housing 30 sized to house a cleaning liquid supply assembly 46 for holding a first cleaning liquid, such as water. Referring also to FIG. 4, the solution supply tank assembly 24 can be removably received by a foot assembly cover 26 attached to the base assembly 20, and can comprise a reservoir 28 for holding a second cleaning liquid, such as a carpet cleaning detergent, which can be combined with the first cleaning liquid to form a cleaning solution.

Figure 5:
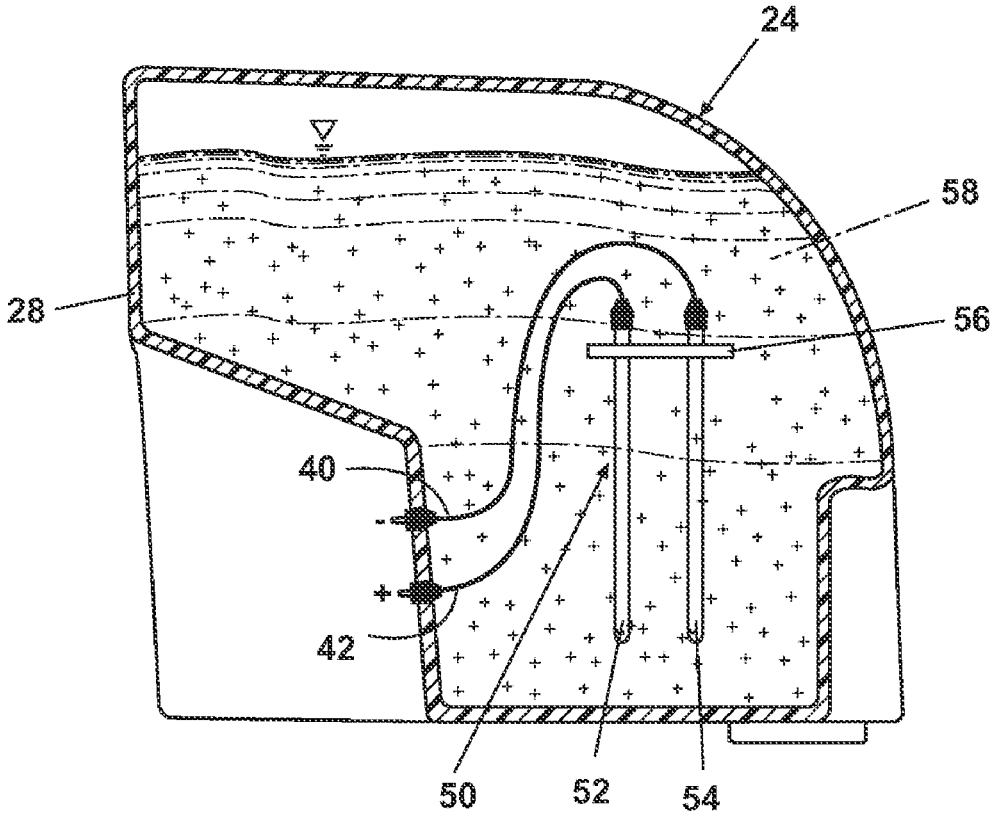
FIG. 5 is a sectional view taken along view line 5-5 of FIG. 4.

Referring to FIGS. 4 and 5, an ion generator 50 comprises a pair of electrodes 52, 54 mounted in a bracket 56 in spaced disposition within the solution supply tank assembly 24 connected through leads 40, 42 to an electric power supply connected to the extractor 10. The electrodes 52, 54 are configured to generate metal ions, preferably silver ions, through a well-known electrolysis process. The electrodes can comprise silver alone, an alloy of silver and copper and/or zinc, or one electrode can comprise silver and the other can comprise copper, in order to provide an anti-microbial effect against a range of bacteria, viruses, molds, fungi, and the like on various surfaces such as carpet, rugs, upholstery, curtains, tile, hardwood floors, and the like.

One of the electrodes comprises an anode 52, which is connected to the positive terminal of the power supply; the other electrode comprises a cathode 54, which is connected to the negative terminal of the power supply. Application of an electrical potential across the electrodes 52, 54 will generate metal ions from the anode 52 in a well known manner. The electrical potential can be any appropriate voltage, and is preferably about 12V DC and a maximum of 42V DC, which can be supplied by either a battery housed within the extractor 10 or through household current using a suitable transformer. The concentration of metal ions generated can be controlled by controlling the electrical potential across the electrodes. The higher the potential, the greater the ion concentration. Thus, if a lower ion concentration is desired, a voltage somewhat less than 12 volts can be applied. The polarity of the electrical potential across the electrodes 52, 54 can be periodically reversed, changing the cathode to an anode and the anode to a cathode, in order to provide for generally equal parasitizing of the electrodes. This is only feasible, however, if both electrodes comprise the same metal. This reversed polarity can be done selectively by an operator according to a preestablished schedule, or can be automatically controlled by a suitable control device, such as a microprocessor-based controller, in the extractor 10.

As illustrated in FIG. 5, when the electrodes 52, 54 are immersed in a liquid 58 contained in the reservoir 28, ionization will result in metal ions being introduced into the liquid 58 from the cathode 54. The ionized liquid 58 can be distributed through the liquid distribution assembly 34 to the surface to be cleaned. An optimal concentration of ions may be dependent on factors such as the source metal (e.g. silver vs. copper vs. zinc), the surface on which the ions are deposited (e.g. carpet vs. tile vs. wood), the temperature and pH of the liquid carrying the ions, the concentration at which the ions begin to come out of solution, potential toxicity to humans and pets, the targeted microorganisms, and the like. Concentrations of silver ions that have been found to have an antibacterial effect can range from about 9 to 250 parts per billion (ppb). "*Exploring the Effects of Silver in Wound Management-What is Optimal?*", R. White, et al., *Wounds: A Compendium of Clinical Research and Practice*, Vol. 18, No. 11 (2006).

The electrodes 52, 54 are illustrated in FIG. 5 as being mounted within the solution supply tank assembly 24. Thus, the metal ions will be introduced into the carpet cleaning detergent. However, the electrodes 52, 54 can also be mounted within the cleaning liquid supply assembly 46 for introducing metal ions into the liquid, i.e. water, contained therein. This mounting would introduce the ions into the water prior to a final rinse, and deposited onto the surface during the final rinse. The ions would remain on the surface after completion of the cleaning operation. If the detergent were utilized to deliver the ions to the surface, it would be necessary to adjust the ion concentration or the detergent application time in order to realize the beneficial effect of the ions on the surface prior to removal of the detergent solution from the surface.

The electrolysis described herein cannot be carried out in deionized water. Tap water, whether from a well or a surface water source, will typically contain sufficient impurities, i.e. electrolytes, to enable electrolysis to proceed. A selected volume of an electrolyte can also be introduced into the liquid having a suitable composition and properties to facilitate electrolysis and the distribution of ions throughout the liquid. Depending upon the liquid in which electrolysis is to occur, the electrolyte can be added to the carpet cleaning detergent, or can be introduced as a non-detergent liquid into the cleaning fluid supply assembly 46 for mixing with the water. For example, the electrolyte can comprise a component of a rinsing aid or an anti-sudsing liquid added to the rinse water. The properties of the electrolyte, such as chemical formula, constituent concentrations, pH, and the like may be dependent on such factors as the selected metal ion being generated and deposited, as well as the above identified factors relating to an optimal concentration of ions.

Figure 6:
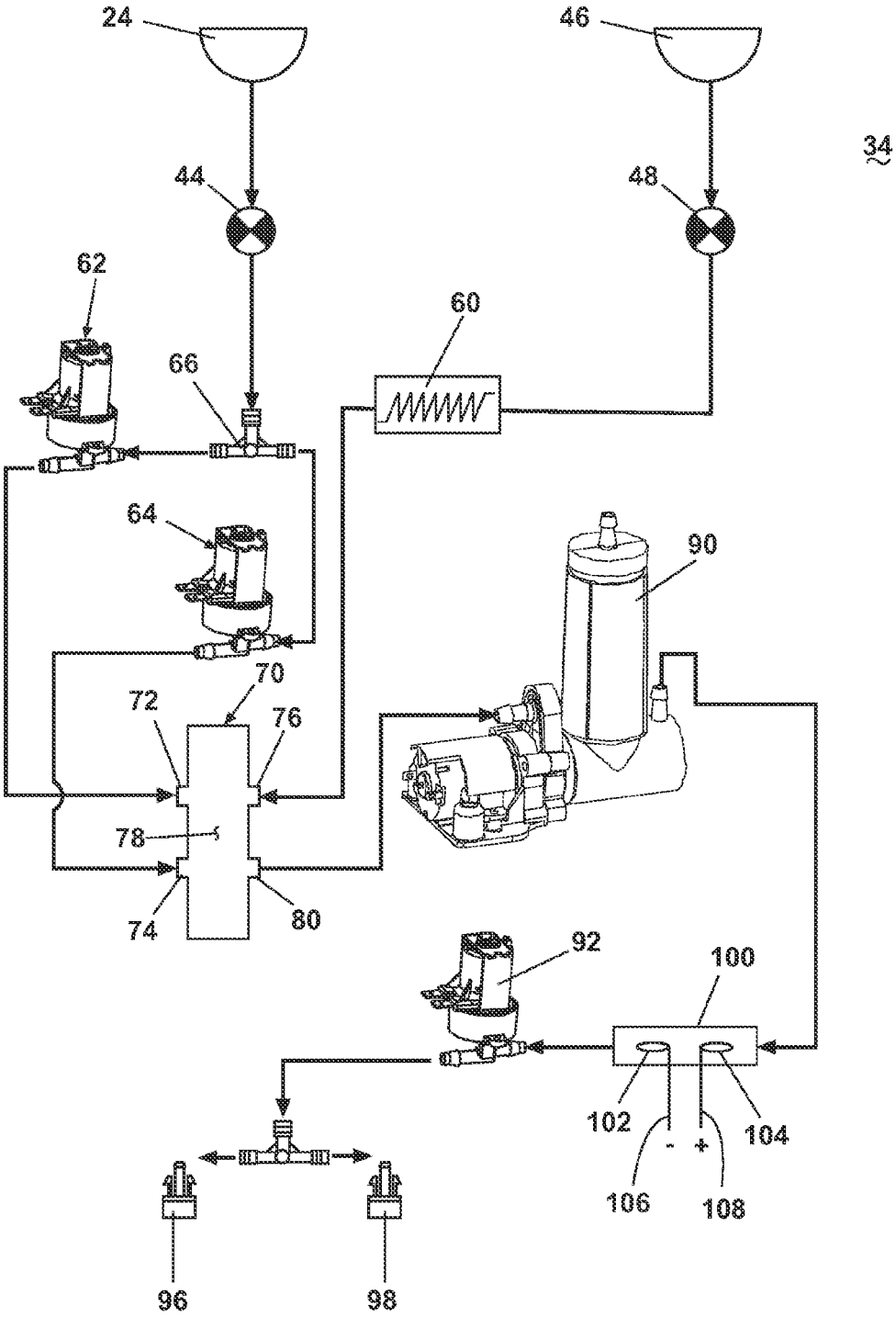
FIG. 6 is a schematic view of an alternate embodiment of the ion generator according to the invention mounted in an extractor liquid distribution line.

FIG. 6 schematically illustrates a second embodiment of a metal ion generator 100 coupled with the liquid distribution assembly 34. The solution supply tank assembly 24 can contain a detergent, and the cleaning liquid supply assembly 46 can contain water. The solution supply tank assembly 24 includes an outlet in a bottom wall thereof fluidly coupled with a valve mechanism 44 for controlling the flow of liquid from the solution supply tank assembly 24, and is connected through the valve 44 to a splitter 66 which diverts detergent flowing from the solution supply tank assembly 24 to a first metering valve assembly 62 and a second metering valve assembly 64. The metering valve assemblies are utilized for controlling the flow of detergent to a mixing manifold 70 having a mixing chamber 78 therein. The first metering valve assembly 62 is fluidly coupled to the mixing chamber 78 through a first cleaning liquid inlet 72. The second metering valve assembly 64 is fluidly coupled to the mixing chamber 78 through a second cleaning liquid inlet 74. The metering valve assemblies 62, 64 are utilized to meter the flow of detergent to the mixing manifold 70.

The cleaning liquid supply assembly 46 is aligned with a valve mechanism 48 for controlling the flow of the cleaning liquid from the cleaning liquid supply assembly 46, and is connected through the valve 48 to a heater 60 for selectively heating the water, which can be selectively coupled into the liquid distribution assembly 34 at other suitable locations. The cleaning liquid supply assembly 46 is fluidly coupled to the mixing chamber 78 downstream of the heater 60 through a third cleaning liquid inlet 76 for mixing the water with the detergent in preselected, controlled proportions to produce a cleaning solution. The cleaning solution is discharged from the manifold 70 through an outlet 80 which is fluidly coupled to a pump assembly 90. The pump assembly 90 delivers the cleaning solution to a pair of spray jets 96, 98 through a metering valve assembly 92.

As illustrated in FIG. 6, the ion generator 100 can be coupled at suitable selected locations within the liquid distribution assembly 34, such as between the pump 90 and the metering valve assembly 92. In this embodiment, the cathode 102 and the anode 104 are connected through leads 106, 108, respectively, to an electric power supply for generating metal ions in the cleaning solution flowing through the ion generator 100. The ion generator 100 can be selectively actuated to introduce metal ions into the cleaning solution comprising water and detergent for distribution onto the surface during cleaning, or into the rinse water for distribution onto the surface during rinsing.

The ion generator described here is not limited for use in an upright extractor. The ion generator can be employed for any suitable surface cleaning apparatus, including, but not limited to, hand-held extractors, canister extractors, upright and canister vacuum cleaners, shampooing machines, mops, bare floor cleaners, and the like.

While the invention has been specifically described in connection with certain specific embodiments thereof, it is to be understood that this is by way of illustration and not of limitation. Reasonable variation and modification are possible within the scope of the forgoing description and drawings without departing from the spirit of the invention, which is defined in the appended claims.

What is claimed is:

1. An apparatus for cleaning a surface, having a liquid dispenser for applying a liquid to a surface, and a liquid recovery assembly having a suction nozzle, a liquid recovery tank, and a suction source for drawing liquid from a surface into said recovery tank, the apparatus comprising:

a power supply;

a liquid distribution assembly including:

a cleaning liquid supply reservoir for holding a supply of cleaning liquid, a surface cleaner liquid supply reservoir for holding a surface cleaner including at least one of a detergent and a surfactant for combining with a supply of cleaning liquid from said cleaning liquid supply reservoir to form a cleaning solution; and a metal ion generator having a pair of metallic electrodes in spaced disposition, said metal ion generator being adapted to introduce metal ions into the cleaning liquid when coupled to the power supply and power is supplied to the electrodes.

2. The apparatus according to claim 1 wherein the metal ion generator comprises an anode and a cathode connected to an electric power supply.

3. The apparatus according to claim 2 and further comprising a potentiometer for adjusting the voltage differential across the anode and the cathode.

4. The apparatus according to claim 3 and further comprising a switch for selectively reversing the polarity of the electrical potential across the anode and the cathode.

5. The apparatus according to claim 4 wherein the metal ions are selected from the group consisting of silver, zinc, and copper.

6. The apparatus according to claim 1 wherein the metal ions are selected from the group consisting of silver, zinc, and copper.

7. The apparatus of claim 1 wherein the metal ion generator introduces ions into the cleaning liquid stored in the cleaning liquid supply reservoir.

8. The apparatus of claim 1 wherein the metal ion generator introduces ions into the cleaning liquid downstream from the cleaning liquid supply reservoir, but before the cleaning liquid has been dispensed from the apparatus onto the surface being cleaned.

9. The apparatus according to claim 1 wherein the metal ions are selected from the group consisting of zinc and copper.

10. The apparatus according to claim 1 wherein the metal ions comprise at least two of silver, zinc and copper.

* * * * *